US005261239A

United States Patent [19]

Barbier et al.

[11] Patent Number: 5,261,239

[45] Date of Patent: Nov. 16, 1993

[54] LEAN PREMIXTURE COMBUSTION-CHAMBER COMPRISING A COUNTERFLOW ENCLOSURE TO STABILIZE THE PREMIXTURE FLAME

[75] Inventors: Gérard Y. G. Barbier, Morangis; Xavier M. H. Bardey, Chartrettes; Michel A. A. Desaulty, Vert Saint Denis; Serge M. Meunier, Le Chatelet en Brie, all of France

[73] Assignee: Societe Nationale d'Etude et de Construction de Motors d'Aviation, Paris, France

[21] Appl. No.: 840,812

[22] Filed: Feb. 25, 1992

[30] Foreign Application Priority Data

Feb. 28, 1991 [FR] France ..... 91 02389

[51] Int. Cl.[5] ..... F23R 3/42; F02C 3/14

[52] U.S. Cl. ..... 60/731; 60/733; 60/743

[58] Field of Search ..... 60/737, 733, 746, 747, 60/748, 760, 731

[56] References Cited

U.S. PATENT DOCUMENTS 3,899,884 8/1975 Ekstedt .
3,934,409 1/1976 Quillévéré et al. ..... 60/733
4,168,609 9/1979 Greenberg et al. ..... 60/746

FOREIGN PATENT DOCUMENTS 0047928 3/1983 Japan ..... 60/747
0240833 11/1985 Japan ..... 60/733
2010407 6/1979 United Kingdom .

OTHER PUBLICATIONS

Carlstrom, L. A. "Improved Emissions Performance in Today's Combustion System." AEG/SOA 7805 (Jun., 1978): p. 17.

Lefebvre, Arthur H. *Gas Turbine Combustion.* New York, N.Y.: McGraw-Hill, 1983. pp. 17-20.

*Primary Examiner*—Richard A. Bertsch
*Assistant Examiner*—Timothy S. Thorpe
*Attorney, Agent, or Firm*—Bacon & Thomas

[57] ABSTRACT

A combustion chamber suitable for use in a gas turbine engine includes a first enclosure with a fuel injector for low-power operation and a primary-oxidizer intake, a second enclosure with a fuel injector for full-power operation and a primary-oxidizer intake, and a third enclosure from which to evacuate burnt gases and which communicates with the first and second enclosures. The wall of the first enclosure includes intake orifices for a dilution oxidizer, but the wall bounding the second enclosure lacks any orifices other than the primary-oxidizer intake orifices.

11 Claims, 1 Drawing Sheet

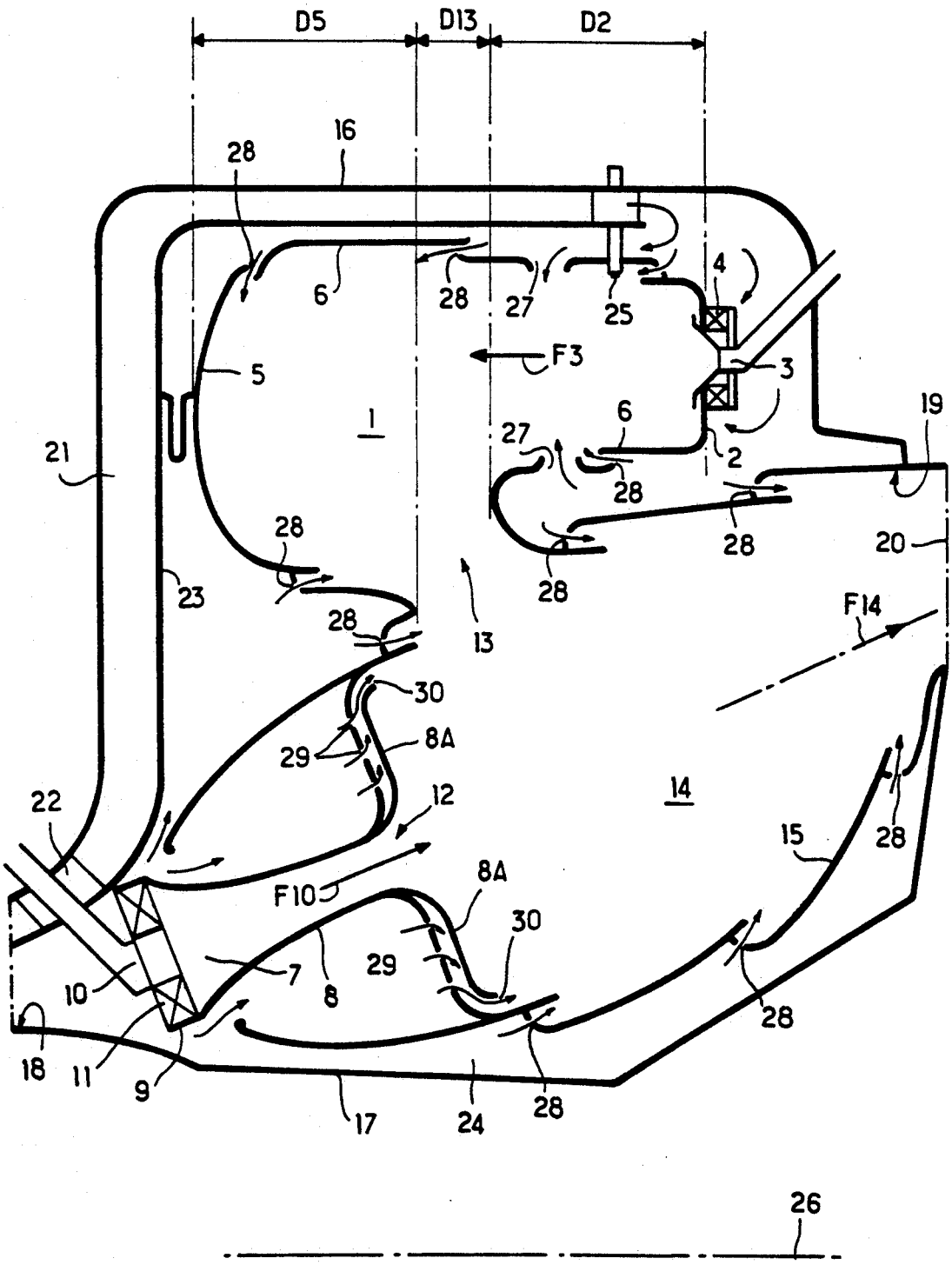
D5
D13
D2
16
28
6
28
27
25
4
F3
3
5
1
6
19
21
27
2
28
28
28
20
23
28
28
13
F14
30
29
8A
14
22
12
15
28
F10
8A
30
29
7
8
10
28
18
11
9
17
24
28
26

LEAN PREMIXTURE COMBUSTION-CHAMBER COMPRISING A COUNTERFLOW ENCLOSURE TO STABILIZE THE PREMIXTURE FLAME

BACKGROUND OF THE INVENTION

1. Field of the Invention

This invention relates to gas turbine engines and, in particular to a combustion chamber therefor.

2. Description of Related Art

A known combustion chamber, which is suitable for use in gas turbine engines, includes a first low-power fuel injection enclosure with its own primary-oxidizer orifices, and a second full-power fuel injection enclosure distinct from the first enclosure with a second fuel injector for full-power operation. The known combustion chamber also includes an enclosure for exhausting burnt gases which is distinct from the first and second enclosures.

In this known combustion chamber, the first enclosure equipped with the low-power fuel injector lacks dilution orifices, while the second enclosure is provided with them. The second enclosure is equipped with the full-power fuel injector is arrayed in series with and following the first enclosure but lacks it own primary-oxidizer intake. As a result, the known design is a potential pollution source because of the low probability that the oxidizer supply will be optimal.

SUMMARY OF THE INVENTION

The objective of the invention is to remedy the various observed drawbacks of the conventional gas turbine combustion chamber.

This objective is achieved by providing, in accordance with a preferred embodiment of the invention, a dual-enclosure combustion chamber such as defined above wherein the wall bounding the first enclosure includes intake orifices for the dilution oxidizer, but the wall bounding the second wall is free of orifices except for primary-oxidizer intake orifices which provide a lean premixture inside the second enclosure.

In addition, the inventive combustion chamber preferably further includes the following features:

- the first enclosure is mounted in a counterflow relationship with respect to the second enclosure, such that the fuel injection by the first fuel injector is essentially in a direction opposite to the direction of fuel injection by the second fuel injector and opposite to the direction of gas-evacuation from the gas-exhaust enclosure,
- the second enclosure and the gas-exhaust enclosure each define a principal fluid flow axis, the respective principal axes are essentially parallel to one another, and one is the extension of the other,
- the wall of the first enclosure is made up of a first portion constituting a support for the first fuel injector and a second portion constituting a longitudinal base of the first enclosure and opposite to, but distant from, the support, the orifice through which the first enclosure communicates with the gas-exhaust enclosure being located in a third wall portion essentially equidistant from the support and the base,
- the fuel/oxidizer mixture which can be achieved in the first enclosure is a rich mixture relative to the stoichiometric mixture, and

- the fuel/oxidizer mixture which can be achieved in the second enclosure is a lean premixture relative to the stoichiometric mixture.

The main advantages of the invention include the feasibility of achieving good combustion stability and lower pollution in the various desired operating modes, especially at low power and at full load.

BRIEF DESCRIPTION OF THE DRAWING

The lone FIGURE is a schematic drawing of an axial section of a combustion chamber constructed in accordance with the principles of a preferred embodiment of the invention.

DETAILED DESCRIPTION OF THE PREFERRED EMBODIMENT

The combustion chamber illustrated in the lone FIGURE includes a first enclosure 1 bounded by a wall with a first portion constituting a support 2 for a first fuel injector 3 and including primary-oxidizer intake orifices 4. one or more spark plugs 25 are located near injector 3. First enclosure 1 is bounded by a second portion opposite to, but distant from, the support 2 which constitutes the base 5 of the first enclosure, and by a linkage part 6 connecting support 2 and base 5.

A second enclosure 7 is bounded by a wall 8 shaped in the manner of a convergent cone of which one base constitutes a support 9 of a second fuel injector 10 and which includes corresponding primary-oxidizer intake orifices 11. The other base of the convergent cone structure constitutes a communication orifice 12. Wall 8 joins wall 6 in the zone of a communication orifice 13 in wall 6.

A third enclosure 14, which is the gas-exhaust enclosure, is bounded by a wall 15. Entry of gases from the first enclosure 1 is through communication orifice 13, and entry from the second enclosure 7 is through the communication orifice 12.

A casing comprising an external wall 16 and inner wall 17 surrounds the first, second and third enclosures, 1, 7, and 14, respectively, and including two orifices 18 and 19. Orifice 18 is for the upstream, overall intake of compressed-oxidizer. Orifice 19 is crossed by the wall 15 near orifice 20, the burnt gases contained in the third enclosure 14 being evacuated from orifice 19 through orifice 20.

The space 21 between the casing external wall 16 and the corresponding parts of wall 6, support 2 and base 5 may optionally hold—for instance in the manner shown—an additional compressor 22. For that purpose, a partition 23 inside the casing separates the casing inside into two distinct volumes, namely space 21 and a space 24 bounded by partition 23, by the wall 8, and by the remaining segments of the base 5 and wall 6. The space 24 communicates directly with the orifice 18 of the upstream overall compressed-oxidizer intake.

As shown in the FIGURE, the above structures are preferably arranged such that the fuel-injection directions F3 and F10 of the fuel injectors 3 and 10 are substantially opposite, the first and second enclosures 1 and 7 being arranged in a "counterflow" manner such that gases enter the third enclosure 14 through respective communication orifices 13 and 12 to flow in a mutually parallel direction.

The distances D2 and D5 (as measured parallel to an axis 26 of the casing's external and inner walls 16 and 17 separating the limit-edges of the communication orifice 13 from the support 2 and from the base 5 respectively), are substantially equal. The longitudinal strip of width D13 within which the communication orifice 13 is located is therefore substantially equidistant from the support 2 and the base 5.

Wall 6 is crossed in the zone of the first enclosure 1 near the fuel injector 3 by intake orifices 27 for the oxidizer (air) diluting the gases generated by the combustion of the fuel injected by the fuel injector 3 and the primary oxidizer fed through the intake orifices 4. On the other hand, the only intake orifices in second enclosure 7 are the primary-oxidizer intake orifices 11. Enclosure 7 lacks any intake orifices for the dilution oxidizer. As a result, the fuel injector 3 is the one which allows operation of the combustion chamber for lower power, at low load, and is designed to provide a mixture which is rich relative to the stoichiometric mixture, while fuel injector 10 allows operation of the combustion chamber at full power, at full load, and in turn is designed to achieve a lean mixture relative to the stoichiometric mixture.

A fluid flow axis F14 of the third enclosure 14 is substantially parallel to and forms an extension of fluid flow axis F10, which is the axis of fuel injection subtended by the fuel injector 10. The axis F10 substantially constitutes the principal geometric axis of second enclosure 7.

The walls 6 and 15 of the first and third enclosures 1 and 14 include collars joined to one another and equipped, at their junctions to one another, with a series of intake orifices 28 for oxidizer films that cool the hot walls 6 and 15.

The segments 8A of the wall 8 joining walls 6 and 15 located beyond the communication orifice 12 and contributing to bounding the third enclosure 14 are double walls. The inside of walls 6 and 15 can be entered by the compressed oxidizer from the space 24, and by passing through upstream orifices 29. The compressed oxidizer is thus able to discharge through downstream orifices 30 into the third enclosure 14, with the result that the oxidizer compressed inside the double wall 8A by its circulation cools the double wall 8A.

The third enclosure 14 constitutes the exhaust chamber for the gases burnt in the first enclosure 1 and in the second enclosure 7 if the full-load mode. The two end modes of operation are the low power mode, with only the first fuel injector 3 being operational, and the full load mode, in which the second fuel injector 10 also is operational.

The illustrated invention allows violent combustion of the rich mixture in the first enclosure 1, the combustion being stable and low-polluting because of the counterflow configuration, indicated by directional arrow F3, of the injection into this enclosure relative to the evacuation direction F14 of the gases burnt outside the enclosure 14. Combustion in the second enclosure 7, on the other hand, takes place in a pre-mixture enclosure and involves a very lean mixture. This combustion may be initiated catalytically and/or by supplying hot gases from the first enclosure.

The invention thus allows low-pollution operation at full load, the low-power and full-load modes corresponding to mixtures, one of which is rich, the other being lean, and both being far from the most polluting stoichiometric mixture. Moreover, full-load operation takes place with a very homogenous, stable and lean mixture.

It should of course be appreciated by those skilled in the art that the invention is not to be restricted solely to the above-described embodiment, but on the contrary that the invention as defined in the appended claims is intended to cover all variations which will occur to the skilled artisan based on the more general principles on which the invention is based.

We claim:

1. A combustion chamber suitable for use in a gas turbine engine, comprising:

a first enclosure which includes means comprising a first fuel injector for injecting fuel for low-power operation, and first primary-oxidizer intake orifices, a second enclosure distinct from the first enclosure, which includes means comprising a second fuel injector for injecting fuel for full-power operation, and second primary-oxidizer intake orifices; and, means including a third enclosure for evacuating burnt gases, said third enclosure being distinct from said first and second enclosures and in direct communication with both the first and second enclosures, wherein:

a wall bounding the first enclosure includes means defining secondary intake orifices for passing a dilution oxidizer; a wall bounding the second enclosure is free of any orifices except said primary-oxidizer intake orifices; and, the first enclosure is parallel to and in a counter-flow configuration relative to the second enclosure.

2. A combustion chamber as claimed in claim 1, wherein the first fuel injector is arranged such that fuel injection by the first fuel injector is in a direction substantially opposite an injection direction of the second fuel injector and also substantially opposite to a direction of gas evacuation from the third enclosure.

3. A combustion chamber as claimed in claim 2, wherein the second enclosure and the third enclosure each includes a principal fluid flow axis, and wherein the axes of these two enclosures are substantially mutually parallel and form extensions of one another.

4. A combustion chamber as claimed in claim 1, wherein a wall of the first enclosure comprises a first portion constituting a support of the first fuel injector and a second portion constituting a base of the first enclosure and opposite to but spaced from said support, and wherein an orifice by means of which said first enclosure communicates with the third enclosure is located in a third wall portion which is substantially equidistant from said support and said base.

5. A combustion chamber as claimed in claim 1, wherein said first fuel injector, first primary-oxidizer intake orifices, and secondary intake orifices constitute means for providing an oxidizer/fuel mixture in the first enclosure which is a rich mixture relative to a stoichiometric mixture.

6. A combustion chamber as claimed in claim 1, wherein said second fuel injector, second primary-oxidizer intake orifices, and wall bounding the second enclosure constitute means for providing an oxidizer/fuel mixture in the second enclosure is a lean premixture relative to the stoichiometric mixture.

7. A combustion chamber suitable for use in a gas turbine engine, comprising:

a first enclosure which includes means comprising a first fuel injector for injecting fuel for low-power operation, and first primary-oxidizer intake orifices, a second enclosure distinct from the first enclosure, which includes means comprising a second fuel injector for injecting fuel for full-power operation, and second primary-oxidizer intake orifices, and, means including a third enclosure for evacuating burnt gases, said third enclosure being distinct from said first and second enclosures and in direct communication with both the first and second enclosures, wherein:

a wall bounding the first enclosure includes means defining secondary intake orifices for passing a dilution oxidizer; a wall bounding the second enclosure is free of any orifices except said primary-oxidizer intake orifices; a wall of the first enclosure comprises a first portion constituting a support of the first fuel injector and a second portion constituting a base of the first enclosure and opposite to but spaced from said support; and an orifice by means of which said first enclosure communicates with the third enclosure is located in a third wall portion which is substantially equidistant from said support and said base.

8. A combustion chamber as claimed in claim 7, wherein the first fuel injector is arranged such that fuel injection by the first fuel injector is in a direction substantially opposite an injection direction of the second fuel injector and also substantially opposite to a direction of gas evacuation from the third enclosure.

9. A combustion chamber as claimed in claim 8, wherein the second enclosure and the third enclosure each includes a principal fluid flow axis, and wherein the axes of these two enclosures are substantially mutually parallel and form extensions of one another.

10. A combustion chamber as claimed in claim 7, wherein said first fuel injector, first primary-oxidizer intake orifices, and secondary intake orifices constitute means for providing an oxidizer/fuel mixture in the first enclosure which is a rich mixture relative to a stoichiometric mixture.

11. A combustion chamber as claimed in claim 7, wherein said second fuel injector, second primary-oxidizer intake orifices, and wall bounding the second enclosure constitute means for providing an oxidizer/fuel mixture in the second enclosure is a lean premixture relative to the stoichiometric mixture.

* * * * *